United States Patent [19]

Kammerer et al.

[11] Patent Number: 4,797,309

[45] Date of Patent: Jan. 10, 1989

[54] FOIL POUCH

[75] Inventors: Gene W. Kammerer, East Brunswick; Donald Barcan, Maplewood, both of N.J.

[73] Assignee: Johnson & Johnson Orthopaedics, Inc., New Brunswick, N.J.

[21] Appl. No.: 133,596

[22] Filed: Dec. 14, 1987

[51] Int. Cl.[4] ..... B65D 47/10

[52] U.S. Cl. ..... 428/35.3; 206/620; 206/630; 206/484; 222/527; 222/541

[58] Field of Search ..... 206/484.2, 604, 620, 206/630, 632, 484; 222/96, 527, 541; 428/35

[56] References Cited

U.S. PATENT DOCUMENTS

| | | | |
|---|---|---|---|
| 3,083,876 | 4/1963 | Schneider et al. | 206/620 |
| 3,917,116 | 11/1975 | Mason | 222/541 |
| 4,696,393 | 9/1987 | Laipply | 206/484 |

*Primary Examiner*—George F. Lesmes
*Assistant Examiner*—James J. Seidleck
*Attorney, Agent, or Firm*—Michael Q. Tatlow

[57] ABSTRACT

The present invention provides a foil laminate pouch with an attached spreader having an arcuate edge affixed to the pouch to allow the contents of the pouch to be readily spread over the area to which the contents are to be applied.

4 Claims, 2 Drawing Sheets

12
2
24
18
25
16
14
17
16
20
13
19
10
15
2
11

25
18
17
24
10
14
16

14
13
11
12
10
21
15
20
22
19
21
18
17
25

FOIL POUCH

BACKGROUND OF THE INVENTION

The present invention relates to a foil pouch container with an attached spreader which is useful in the application of moisture-sensitive, viscous liquids to curved surfaces, particularly to rigid curved surfaces. The container has particular utility in the application of moisture-sensitive polyurethane resins which are used to reinforce orthopedic casts.

U.S. Pat. Nos. 4,643,909 and 4,690,842 disclose polyurethane compositions which are used to reinforce or repair orthopedic casts made with polyurethane casting tapes. The polyurethane reinforcing composition has a high viscosity and is applied to the cast in areas where the case must be reinforced or repaired. The above-mentioned patents disclose employing small capacity containers such as foil packages or tubes similar to toothpaste tubes to contain the polyurethane composition. The polyurethane reinforcing composition is applied to the cast on the limb of the patient and then spread over the areas to be reinforced.

The polyurethane reinforcing compositions disclosed in the above-mentioned patents are not only viscous, but also are very moisture sensitive and may be tacky to the touch. The present invention is a foil pouch with an attached spreading device which allows these compositions to be readily applied to the areas of a cast where reinforcement is desired in a uniform and controlled manner with minimum contact to the hands of the person applying the composition.

SUMMARY OF THE INVENTION

The present invention provides a foil laminate pouch or pouch with an attached spreading device affixed to the pouch to allow the contents of the pouch to be readily spread over the area of a cast to be reinforced. The spreader is somewhat rigid, but is bendable and employs an arcuate shape on the spreading end so that the polyurethane composition can be uniformly spread on the curved surfaces of an orthopedic cast. In addition, the pouch has a controlled opening which allows the proper amount of the composition to flow from the pouch when the pouch is squeezed so that the proper thickness and amount of the resin can be applied in a one-step, single motion. In addition, because of the limited size of the opening of the pouch, the pouch may be closed and self-seals by the hardening of the polyurethane composition to prevent moisture contamination of the remaining contents in the foil laminate container. The application of the reinforcing resin with the pouch of the present invention reduces the necessity of cleaning various instruments after the application of the resin to the cast. The only object which comes in contact with the resin is the foil laminate pouch and the attached spreader.

DETAILED DESCRIPTION OF THE INVENTION

Figure 1:
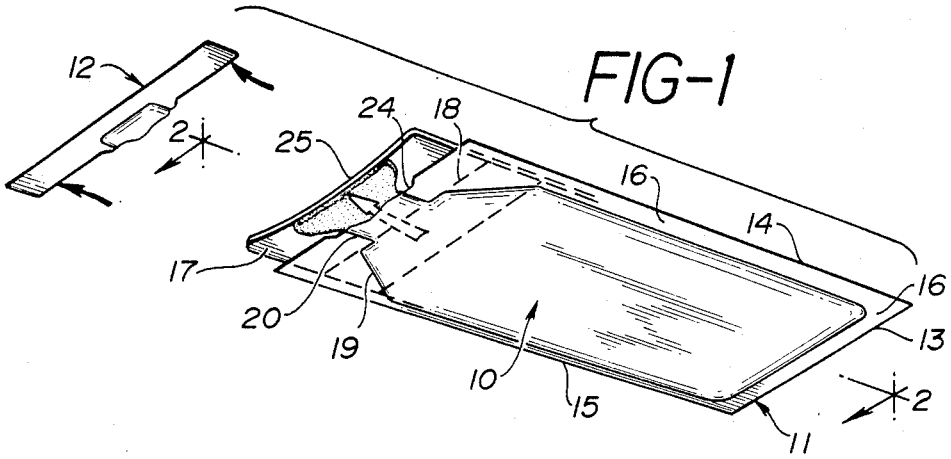
FIG. 1 is an isometric view showing the opened pouch of the present invention.
Figure 4:
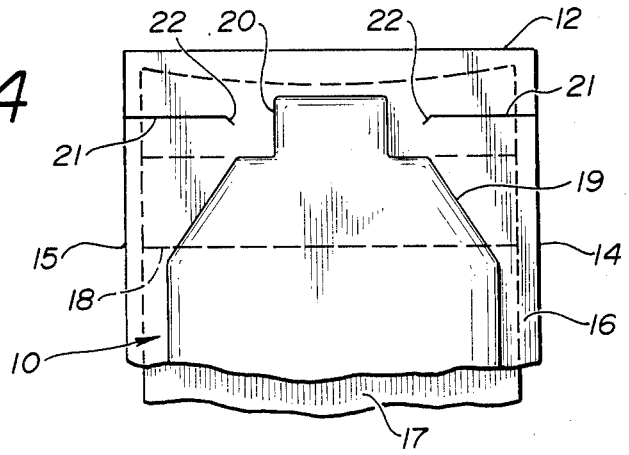
FIG. 4 is a fragmentary view of one side of the top of the pouch.
Figure 5:
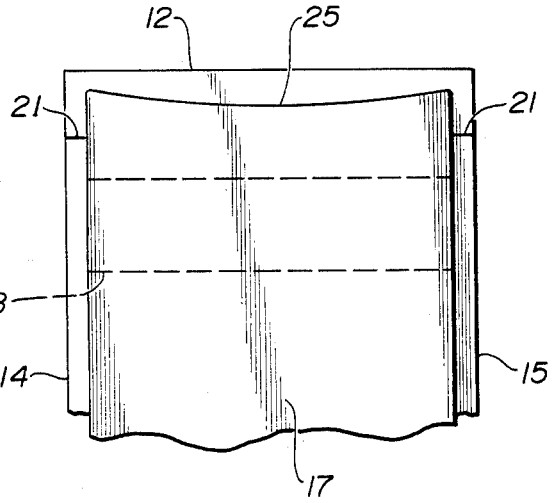
FIG. 5 is a fragmentary view of the bottom of the pouch.

With reference to FIG. 1, container 10 of the present invention consists of a foil laminate packaging material which is sealed around its periphery to form a pouch and which has attached thereto a semi-rigid, bendable spreading device. The foil laminate 11 comprises a moisture-impervious aluminum or other metal layer which has a thermoplastic film or resin coating on one or both surfaces of the metal. Because of the thermoplastic coating or film, the foil laminate can be heat sealed to form the container 10. The pouch has a top edge 12 which has an opening 24 formed therein by tearing the top of the container. The pouch has a bottom edge 13 and two opposed side edges 14 and 15. There is a narrow seal 16 around the side edges and the bottom of the pouch. A spreader 17 is secured to the foil laminate at a position near the top edge of the pouch as will hereinafter be described. The spreader is generally a thin plastic material such as polystyrene polyvinylchloride, polyethylene, polypropylene, or a similar composition. The plastic has a thickness of approximately 0.015 to 0.05 inches and can be readily bent or flexed to assist in the spreading of the resin. The top edge of the spreader has an arcuate shape 25 to allow the resin to be spread around the curves of an orthopedic cast. The radius of curvature of the arcuate edge is from about 4 to 8 inches. The spreader 17 is attached to the foil laminate pouch with a pressure-sensitive adhesive, a hot-melt adhesive or other adhesive 18 at a position below the opening or tear lines of the foil laminate. The configuration of the top edge of the assembled pouch which contains the top edge 12 of the container 10 is best shown in FIG. 4. The heat-sealed neck area at the top edge of the pouch is preferrably formed with an angular seal 19 and a chimney area 20 with parallel sides. The purpose of the chimney area 20 is to control the width of the opened pouch. It should be understood that the angular seal 19 could also be extended at an angle of from 20° to 45° to form a controlled size area at the top of the pouch. Across the top of the foil laminate are tear lines 21 extending from both side edges of the container 10. The tear lines may be discontinuous perforated lines or continuous cut lines. The tear lines terminate at an angled cut line or cut line extension 22 which extends at an angle of from 15° to 90° toward the bottom of the pouch. The cut line extension is from about 1/32 to 1/16 inch long and provides a controlled tear area to insure that the tear line will extend through the width of the chimney 20 to form the controlled size opening 24.

Figure 2:
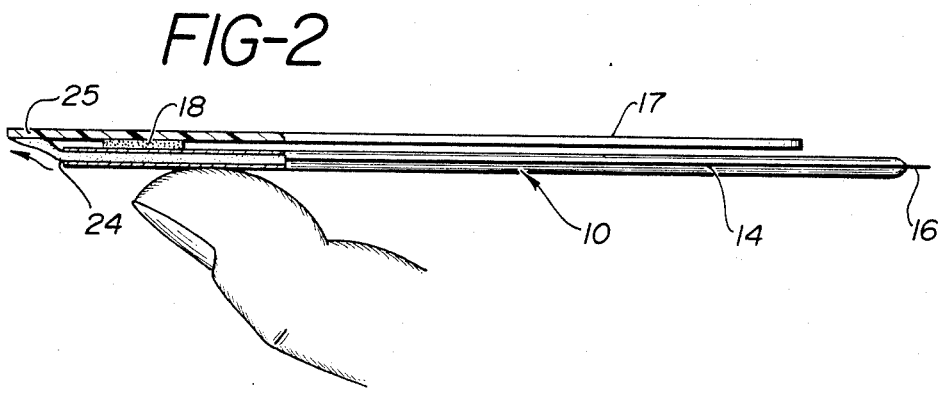
FIG. 2 is a cross-sectional view of the opened pouch taken through line 2—2 of FIG. 1.
Figure 3:
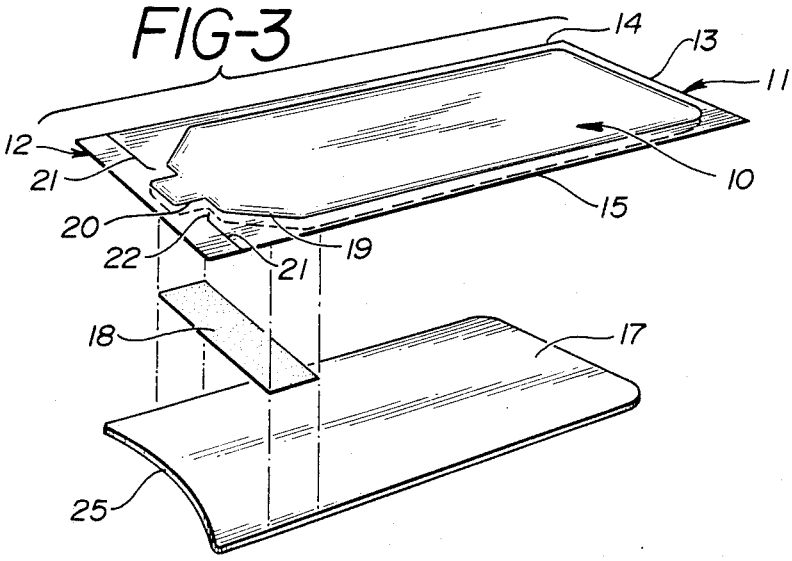
FIG. 3 is an exploded view of the unopened pouch of the present invention showing the positioning of the spreader of the foil pouch.
Figure 6:
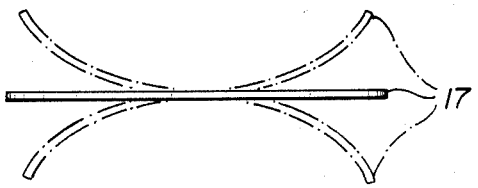
FIG. 6 shows the flexibility of the spreader portion of the pouch.

The spreader 17 has sufficient flexibility that it may be readily bent in the hand to assume the configurations which are shown in the dotted line in FIG. 6. This flexibility allows the spreader to be bent in a curvature which allows it to follow the curvature of a cast on the limb of a patient. The spreader is attached to the foil laminate by the adhesive 18 so that the arcuate edge 25 is spaced adjacent and extends beyond the opening 24 in the foil laminate pouch. There is, therefore, a free end of the spreader which will extend beyond the opening 24 when the pouch is opened and which is shown in FIGS. 1 and 2. The spreader 25 generally is slightly smaller in width than the foil pouch and smaller in length than the pouch.

When using the container, the person applying the resin to reinforce the cast tears the top of the pouch at the tear line 21 across the entire width of the foil laminate in such a manner that the resin is capable of being forced out of the foil laminate pouch when the pouch is squeezed. The resin will flow through the neck area which has a controlled width and therefore a predetermined amount of the resin can be forced out of the pouch. The container can be held by the user with the spreader against the palm of the hand and flexed between the forefinger and thumb to control the curve of the arcuate portion of the spreader. The other fingers of the hand can be pressed against the foil laminate pouch to squeeze the resin out of the open end of the container. Generally, the container is relatively small so that it may be readily controlled with one hand and the resin can be spread over the area of the cast to be reinforced. In a typical configuration, the foil laminate pouch has a width of approximately 2-¾ inches, and a length of 9 inches. The peripheral seals around the side and bottom of the container are approximately ⅜ inches of diameter in width and the opening 24 is approximately ¾ inch across. The tear lines or slits on the side of the opening are approximately ¾ inch long measured from the side edges of the container. The cut line extension 22 is at an angle of 45° directed toward the bottom edge of the pouch and is approximately 1/32 inch long. The spreader is polystyrene 27 mils in thickness and the radius of curvature of the top edge is 6 inches. The spreader is 2½ inches in width and 5½ inches in length and can be flexed with a force of less than 5 pounds. As indicated above, the angled cut line insures that the tear will go through the neck 20 to provide a controlled opening area in the pouch. The spreader is attached to the pouch with a pressure sensitive adhesive applied in a band ⅜ inch wide across the width of the spreader or the pouch.

We claim:

1. A container for a viscous material comprising a pouch formed from two layers of a sealable thermoplastic metal foil laminate having two opposed side edges, a top edge and a bottom edge, the two laminates being sealed at the side edges and the top and bottom edges to form the pouch, a neck adjacent the seal at the top edge of the pouch, a portion of said neck intersecting with tear lines which extend in a substantially straight line from each side edge of the container toward the center of the container, a tear line extension at the end of the straight line portion of the tear lines extending at an angle of from 15° to 90° towards the bottom edge of the container, a spreader secured to one surface of the pouch, said spreader having an arcuate edge, said spreader being secured to said pouch so that the arcuate edge is positioned between the tear line and the top edge of the unopened pouch.

2. The container of claim 1 in which the neck is formed by sealing the laminate from the side edges at an angle of from 20° to 45° toward the top edge of the container.

3. The container of claim 1 in which the end of the neck adjacent the top edge of the container is formed by parallel seal lines.

4. The container of claim 1 in which the arcuate end of the spreader has a radius of curvature of from 4 to 8 inches.

* * * * *